US008836220B2

(12) United States Patent
Leonhardt

(10) Patent No.: US 8,836,220 B2
(45) **Date of Patent: *Sep. 16, 2014**

(54) MODULAR MAGNETRON

(75) Inventor: Darrin Leonhardt, Gaithersburg, MD (US)

(73) Assignee: Heraeus Noblelight Fusion UV Inc., Gaithersburg, MD (US)

( * ) Notice: Subject to any disclaimer, the term of this patent is extended or adjusted under 35 U.S.C. 154(b) by 156 days.

This patent is subject to a terminal disclaimer.

(21) Appl. No.: 13/557,618

(22) Filed: Jul. 25, 2012

(65) Prior Publication Data

US 2012/0286658 A1 Nov. 15, 2012

Related U.S. Application Data

(63) Continuation of application No. 12/504,736, filed on Jul. 17, 2009, now Pat. No. 8,264,150.

(51) Int. Cl.

| | |
|---|---|
| ***H01J 25/50*** | (2006.01) |
| ***H01J 23/00*** | (2006.01) |
| *H01J 65/04* | (2006.01) |

(52) U.S. Cl.

CPC ..... *H01J 23/005* (2013.01); *H01J 65/044* (2013.01); *H01J 25/50* (2013.01)

USPC ..... 315/39.51; 315/39.71; 315/39.63; 315/39.67; 313/153; 313/160

(58) Field of Classification Search

CPC ..... H01J 37/32009; H01J 37/32082; H01J 37/32192; H01J 37/32724; H01J 37/3405; H01J 2237/082; H01J 2237/3146; H01J 2237/2001; H01J 23/005; H01J 25/50; H05B 6/6402; H05B 6/70; H05B 6/80; H05B 6/806

USPC ..... 315/39.51, 39, 111.51, 111.81, 39.55, 315/39.77, 39.53, 39.65, 39.75; 313/240, 313/247, 252, 256, 263, 270, 326, 411; 219/737–738, 736, 741, 757, 531, 526, 219/540, 541, 552, 553, 482, 481, 468

See application file for complete search history.

(56) References Cited

U.S. PATENT DOCUMENTS

| | | | | |
|---|---|---|---|---|
| 4,296,355 | A * | 10/1981 | Fukatsu et al. | 315/39.51 |
| 7,855,495 | B2 * | 12/2010 | Handa | 313/153 |
| 2007/0139125 | A1 * | 6/2007 | Baek et al. | 331/5 |

* cited by examiner

*Primary Examiner* — Thienvu Tran
*Assistant Examiner* — Christopher Lo
(74) *Attorney, Agent, or Firm* — Lowenstein Sandler LLP

(57) ABSTRACT

A modular magnetron for use in UV curing lamp assembly is disclosed. The modular magnetron includes a vacuum tube having a vacuum tube body, a top assembly, and a bottom assembly. The top assembly is configured to substantially overlay the vacuum tube. The bottom assembly is configured to substantially extend about the vacuum tube, the vacuum tube being positioned to partially protrude from the bottom assembly, the bottom assembly including a cooling assembly configured to employ a flexible clamp-type fitting about the vacuum tube body for substantially maintaining thermal and electrical conductivity. The top assembly is configured to be releasably fastened to the bottom assembly about the vacuum tube with removable fasteners.

20 Claims, 6 Drawing Sheets

ASSEMBLED
MAGNETRON

Assembled
Magnetron
and Wave Guide

MODULAR MAGNETRON

CROSS-REFERENCE TO RELATED APPLICATIONS

This application claims the benefit of and is a continuation of U.S. patent application Ser. No. 12/504,736 filed Jul. 17, 2009, the disclosure of which is incorporated herein by reference in its entirety.

FIELD OF THE INVENTION

The invention relates generally to magnetrons, and more particularly, to a modularly assembled magnetron for use in ultraviolet radiation (UV) curing lamp assemblies.

BACKGROUND OF THE INVENTION

Radiant energy is used in a variety of manufacturing processes to treat surfaces, films, and coatings applied to a wide range of materials. Specific processes include but are not limited to curing (i.e., fixing, polymerization), oxidation, purification, and disinfection. Processes using radiant energy to polymerize or effect a desired chemical change is rapid and often less expensive in comparison to a thermal treatment. The radiation can also be localized to control surface processes and allow preferential curing only where the radiation is applied. Curing can also be localized within the coating or thin film to interfacial regions or in the bulk of the coating or thin film. Control of the curing process is achieved through selection of the radiation source type, physical properties (for example, spectral characteristics), spatial and temporal variation of the radiation, and curing chemistry (for example, coating composition).

A variety of radiation sources are used for curing, fixing, polymerization, oxidation, purification, or disinfections due to a variety of applications. Examples of such sources include but are not limited to photon, electron or ion beam sources. Typical photon sources include but are not limited to arc lamps, incandescent lamps, electrodeless lamps and a variety of electronic (i.e., lasers) and solid-state sources.

An apparatus for irradiating a surface with ultraviolet light includes a lamp (e.g., a modular lamp, such as a microwave-powered lamp having a microwave-powered bulb (e.g., tubular bulb) with no electrodes or glass-to-metal seals), the lamp having reflectors to direct light (photons) on to the surface. The source of microwave power is conventionally a magnetron, the same source of microwaves typically found in microwave ovens. The microwave-powered bulb typically receives microwaves generated by the magnetron through an intervening waveguide.

FIG. 1 depicts a conventional assembled magnetron 10 for use in a UV curing lamp assembly, while FIG. 2 depicts an exploded view of the components of the magnetron 10 of FIG. 1. The magnetron 10 comprises a bottom yoke 12 having opposing rails 14 and a plurality of holes 15 formed therein, a bottom magnet 16 overlying the bottom yoke 12, and a cooling assembly 18 overlying the bottom magnet 16 and configured to fit between the opposing rails 14 of the bottom yoke 12. The bottom yoke 12, the bottom magnet 16, and the cooling assembly 18 each have a substantially circular bore hole 20, 22, 24 formed centrally therein and configured for receiving a vacuum tube 26.

Referring now to FIGS. 2 and 3, the vacuum tube 26 has a substantially cylindrical shape and includes a top portion 28 enclosing a filament (not shown) that functions as a cathode, the top portion 28 having a pair of electrical connections 30 extending therefrom and electrically connected to the tube's internal filament (not shown). The top portion 28 overlies a vacuum tube body 32 which functions as an anode. The vacuum tube body 32 overlies an antenna dome 34 extending therefrom, the antenna dome 34 being configured to emit microwave radiation.

Referring again to FIGS. 1 and 2, the vacuum tube 26 is adapted to be inserted in the bore holes 20, 22, 24 such that the antenna dome 34 of the vacuum tube 26 extends a predetermined distance from the bottom yoke 12 and is configured to extend into a cavity of a waveguide (not shown). The bore holes 20, 22 each have substantially the same diameter as the antenna dome 34 of the vacuum tube 26, while the bore hole 24 has substantially the same diameter as the vacuum tube body 32. The small gap between the bore holes 20, 22 and antenna dome 34 contains a metal (stainless steel, brass, etc.) mesh gasket (not shown) to produce a reliable electrical connection with standard waveguide components, thereby reducing rf (radiofrequency) leakage and arcing between the two components. The cooling assembly 18 is typically sized and shaped to fit tightly about the vacuum tube body 32 for the purpose of dissipating heat generated in the vacuum tube 26. In typical configurations, the cooling assembly 18 comprises a plurality of thin plates ("fins") that are press-fit on to the vacuum tube body (anode) 32 with the assistance of lubricating oil. The top portion 28 of the vacuum tube 26 is configured to receive a top magnet 36 and a top yoke 38 overlying the top magnet 36. The top magnet 36 and the top yoke 38 each have a substantially circular bore hole 40, 42 having substantially the same diameter as the top portion 28 of the vacuum tube 26. A filter/connection box 43 overlies the top yoke 38 and is configured to receive the top portion 28 of the vacuum tube 26 (not shown) to make electrical connection with the filament leads 30. The filter/connection box 43 contains the external connection leads 46, which receive the magnetron input power. The top yoke 38 has a plurality of holes 44 which are adapted to be aligned with corresponding holes 15 in the opposing rails 14 of the bottom yoke 12. The top yoke 38 is fastened to the bottom yoke 12 by means of screws or rivets (not shown) that are inserted into the aligned holes 15, 44 so as to encase the bottom magnet 16, the cooling assembly 18, the vacuum tube 26, and the top magnet 36 therein and forming the assembled magnetron 10.

Many sensitive applications require periodic replacement of magnetrons as a mechanism to ensure optimum process control. In addition, a magnetron may fail and have to be replaced in a UV lamp assembly. The most likely part to fail is the vacuum tube 26, while other parts in the assembled magnetron 10 are much less likely to fail. Moreover, the portions of the assembled magnetron 10 overlying and underlying the vacuum tube 26 carry significant materials (copper, steel, ferrite) that are rarely recycled when a magnetron fails.

Accordingly, what would be desirable, but has not yet been provided, is a magnetron that facilitates replacement of the vacuum tube 26 without having to replace other parts in the magnetron.

SUMMARY OF THE INVENTION

The above-described problems are addressed and a technical solution achieved in the art by providing a modular magnetron. The modular magnetron comprises a bottom assembly, a top assembly, and a removable vacuum tube. The bottom assembly includes a bottom yoke, a bottom magnet, and cooling assembly. The top assembly includes a top magnet, a top yoke, and a filter/connection box. In a preferred embodiment, the bottom assembly and the top assembly are configured as non-disposable units. The vacuum tube is configured to be replaced during routine lamp maintenance or a vacuum tube failure. Also, this arrangement allows a 'universal vacuum tube' to be employed for both 2 kW and 3 kW applications, with the only vacuum tube product differentiators being the frequency range of operation (low, nominal, or high).

Once the vacuum tube is inserted into the cooling assembly and fastened, the top assembly is fastened to the bottom assembly by screws and nuts with alignment slots or stops in the top yoke and the bottom yoke, respectively.

According to an embodiment of the present invention, a modular magnetron for use in an ultraviolet radiation (UV) curing lamp assembly is disclosed, comprising: a vacuum tube having a vacuum tube body; a top assembly configured to substantially overlay the vacuum tube; and a bottom assembly configured to substantially extend about the vacuum tube, the vacuum tube being positioned to partially protrude from the bottom assembly, the bottom assembly including a cooling assembly configured to employ a flexible clamp-type fitting about the vacuum tube body for substantially maintaining thermal and electrical conductivity, wherein the top assembly is configured to be releasably fastened to the bottom assembly about the vacuum tube with removable fasteners.

According to an embodiment of the present invention, the cooling assembly may be liquid cooled. The cooling assembly may comprise a copper block heat sink. The copper block heat sink has a cylindrical interior aperture bored to match the outer diameter of the vacuum tube body, a facing side of the copper block heat sink being split and fastened with bolts to produce a tight clamp-on fit of the cooling assembly to the vacuum tube body of the vacuum tube to allow repeated vacuum tube removal upon loosening of the bolts. The copper block heat sink is threaded with holes for water connections. Alternatively, the cooling assembly may include a plurality of thin plates for use with forced air cooling.

According to an embodiment of the present invention, the top assembly further comprises at least one top magnet and the bottom assembly further comprises at least one bottom magnet, the at least one top magnet and the at least one bottom magnet each configured to substantially fit about the vacuum tube, the at least one bottom magnet being configured to underlay the cooling assembly. In some embodiments, one of the at least one top magnet and the at least one bottom magnet is made of one of a rare-earth material and Alnico. In other embodiments, at least one of the at least one top magnet and the at least one bottom magnet is an electromagnet.

According to an embodiment of the present invention, the top assembly further comprises a top yoke configured to overly the at least one top magnet and the vacuum tube and a connection box overlying the top yoke, and the bottom assembly further comprises a bottom yoke configured to underlay the at least one bottom magnet and to receive therethrough the vacuum tube. The top yoke is configured to be fastened to the bottom yoke with the removable fasteners. The top yoke and the bottom yoke may each have alignment slots or stops for receiving the removable fasteners. At least two parts comprising at least one of the top assembly and the bottom assembly are configured to be modular by being fastenable with removable fasteners.

According to an embodiment of the present invention, the vacuum top further comprises a top portion with electrical connections extending therefrom, the electrical connections each having one of a push-on type connector and a screw-terminal connection that is accessible through the connection box. The vacuum tube is configured to be keyed within the bottom assembly so that the electrical connections of the vacuum tube mate with the connection box. The connection box includes filter elements to reduce electro-magnetic interference. The bottom assembly is configured to be fastened to a waveguide, the waveguide having an opening for receiving an antenna dome of the vacuum tube, the antenna dome being configured to emit microwave radiation.

According to an embodiment of the present invention, a method for manufacturing a modular magnetron for use in an ultraviolet radiation (UV) curing lamp assembly is disclosed, comprising the steps of: providing a vacuum tube having a vacuum tube body, a top assembly configured to substantially overlay the vacuum tube, and a bottom assembly configured to substantially extend about the vacuum tube, the vacuum tube being positioned to partially protrude from the bottom assembly, the bottom assembly including a cooling assembly comprising a flexible clamp-type fitting; fitting the flexible clamp-type fitting about the vacuum tube body; receiving the vacuum tube in the bottom assembly and the top assembly; and fastening the top assembly to the bottom assembly about the vacuum tube with releasably removable fasteners. The method may further comprise the step of liquid cooling the cooling assembly using a clamp-on a copper block heat sink.

BRIEF DESCRIPTION OF THE DRAWINGS

The present invention may be more readily understood from the detailed description of an exemplary embodiment presented below considered in conjunction with the attached drawings and in which like reference numerals refer to similar elements and in which.

It is to be understood that the attached drawings are for purposes of illustrating the concepts of the invention and may not be to scale.

DETAILED DESCRIPTION OF THE INVENTION

Figure 4:
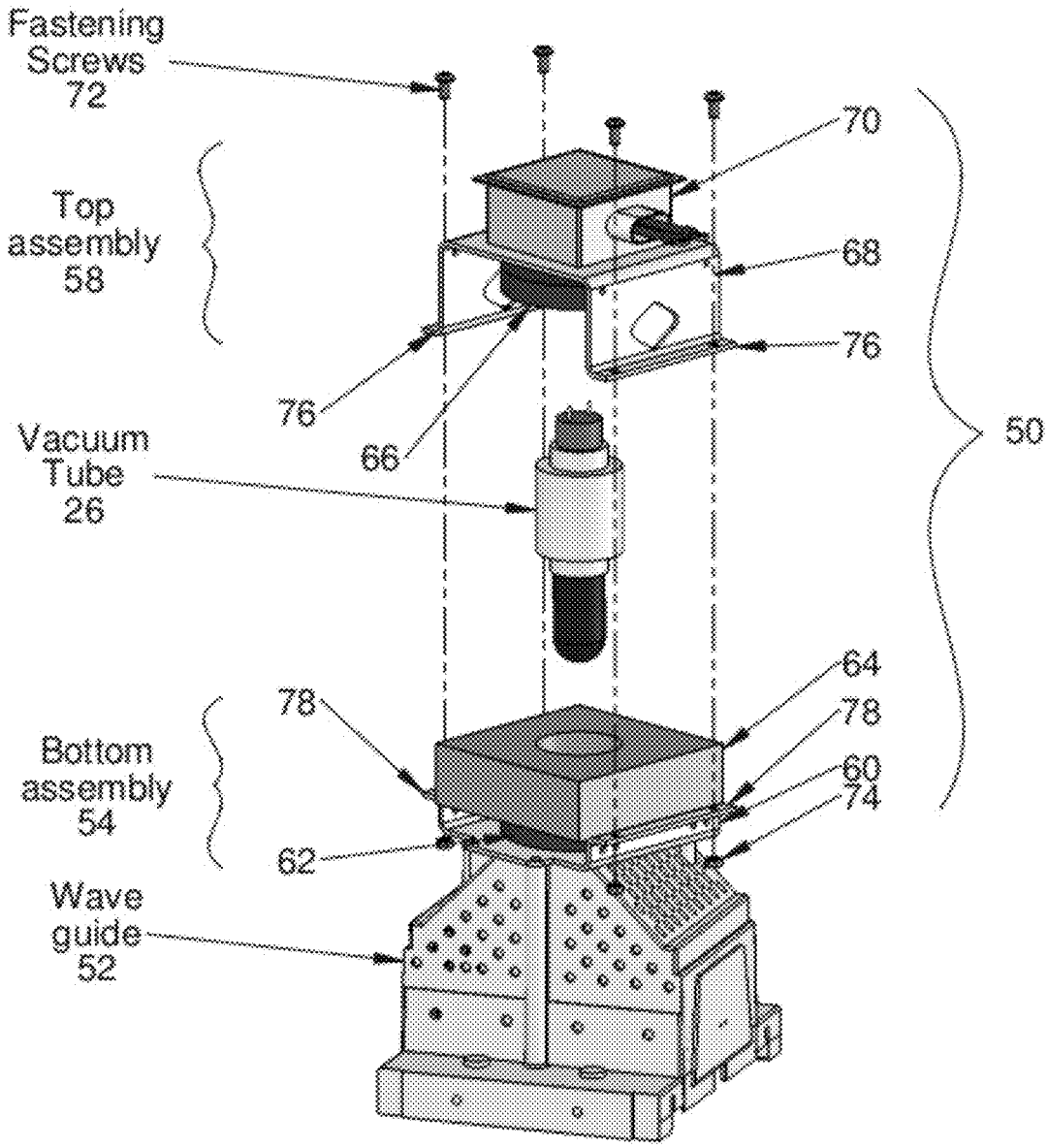
FIG. 4 shows a partial exploded perspective view of a modular magnetron mounted overlying a waveguide, according to an embodiment of the present invention.
Figure 5:
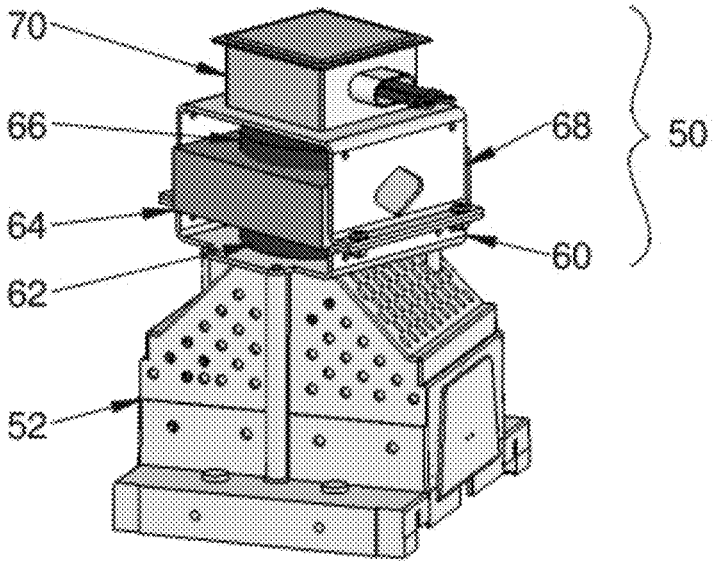
FIG. 5 is an assembled perspective view of the modular magnetron and waveguide of FIG. 4, according to an embodiment of the present invention.

FIG. 4 shows a partial exploded perspective view and FIG. 5 is an assembled perspective view of a modular magnetron 50 mounted overlying a waveguide 52, according to an embodiment of the present invention. Referring now to FIGS. 4 and 5, the modular magnetron 50 includes a bottom assembly 54, a vacuum tube 26, and a top assembly 58. The bottom assembly 54 includes a bottom yoke 60, a bottom magnet 62, and cooling assembly 64. The top assembly 58 includes a top magnet 66, a top yoke 68, and a filter/connection box 70. In a preferred embodiment, the bottom assembly 54 and the top assembly 58 are configured as non-disposable units. The vacuum tube 26 is configured to be replaced during routine maintenance or a vacuum tube failure.

Figure 1:
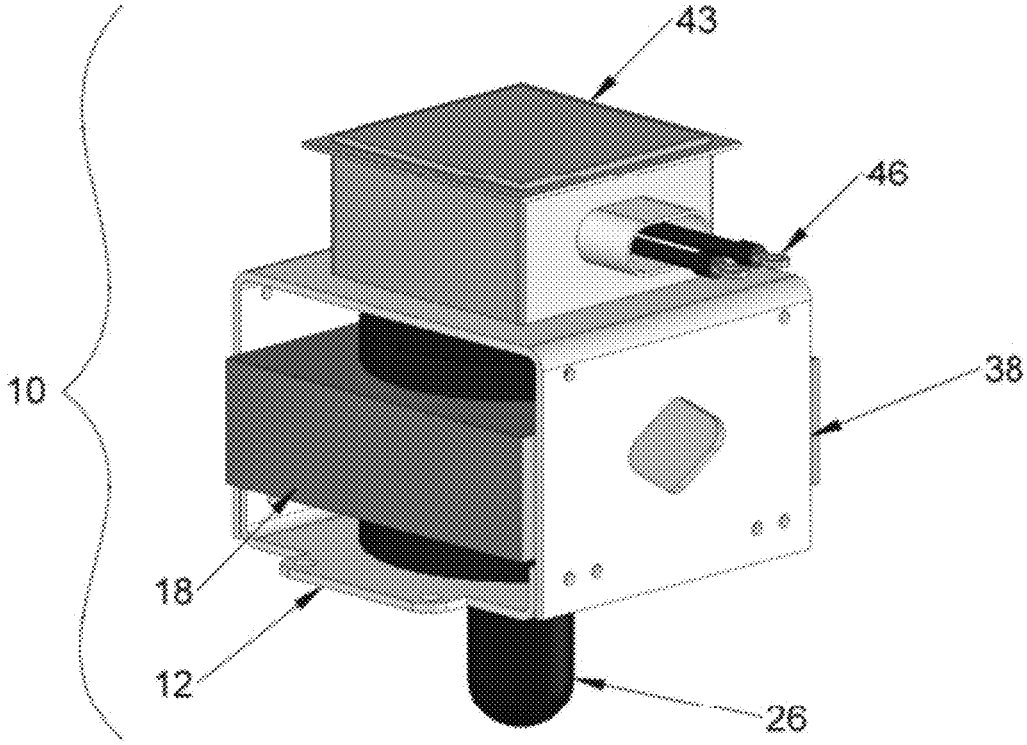
FIG. 1 (prior art)
FIG. 1 depicts a conventional assembled magnetron for use in a UV curing lamp assembly.
Figure 2:
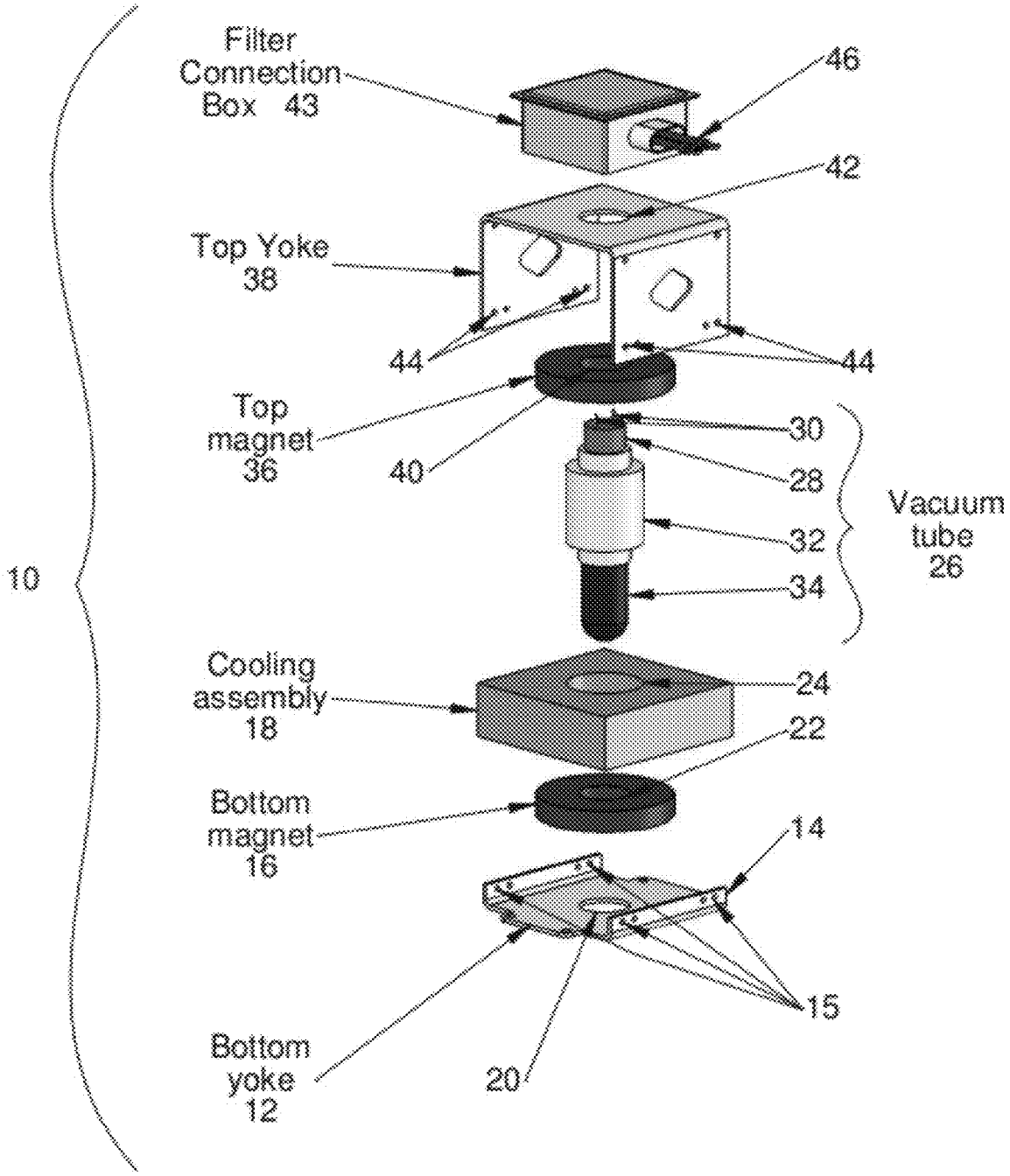
Fig. 2 (prior art)
FIG. 2 depicts an exploded view of the components of the magnetron of FIG. 1.

The bottom assembly 54 is adapted to be mounted overlying the waveguide 52 in a way similar to the prior art (non-modular) magnetron of FIGS. 1 and 2, using screws and the original mounting holes (not shown) on the waveguide. According to a preferred embodiment of the present invention, the parts of the bottom assembly 54 may be "permanently" fastened together using a variety of techniques (rivets, screws, press fittings, etc.). According to other embodiments of the present invention, the bottom assembly 54 may be constructed to be modular, wherein removable fasteners such as stainless steel screws are employed, thereby allowing for the replacement of individual parts (e.g., the bottom magnet 62 may become de-magnetized if exposed to excessive heat).

According to another embodiment of the present invention, the top assembly 58 may be constructed to be modular, wherein removable fasteners such as stainless steel screws are employed to fasten the top yoke 68 to the a filter/connection box 70, with the top magnet 66 unfastened, thereby allowing for the replacement of individual parts.

Figure 3:
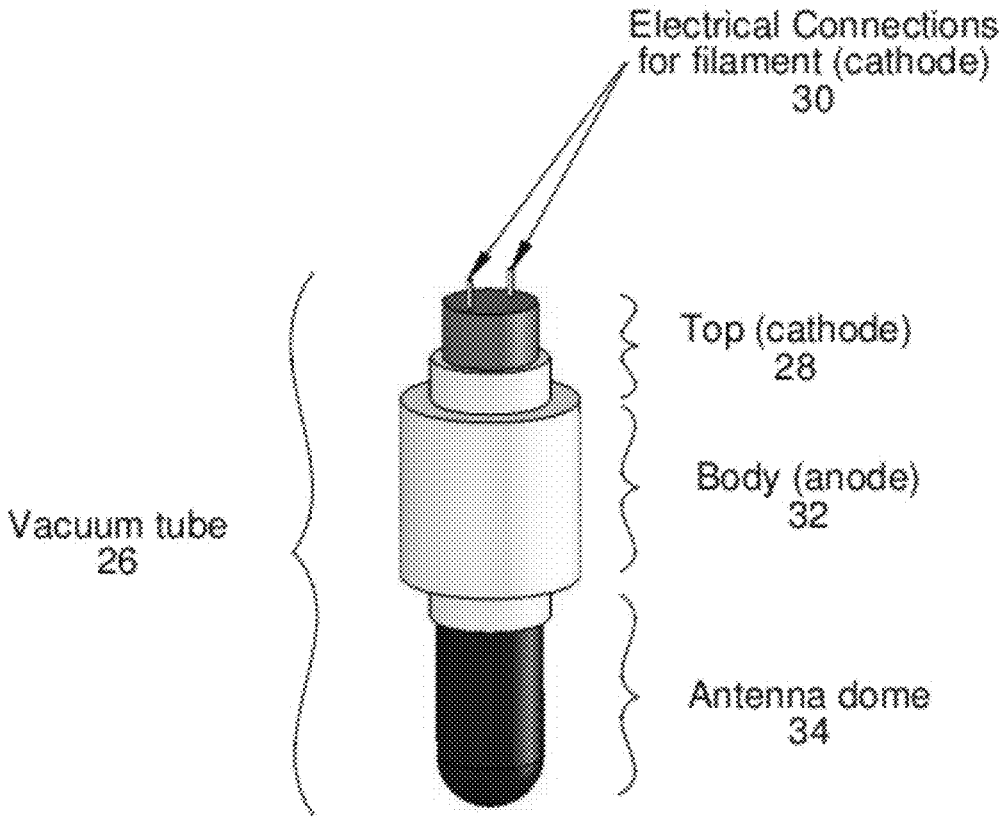
Fig. 3 (prior art)
FIG. 3 depicts a vacuum tube for use in both the conventional magnetron of FIG. 1 and in the present invention.

Referring now to FIGS. 3-5, the vacuum tube 26 is configured to be inserted through bottom assembly 54, with the antenna dome 34 extending a predetermined distance into the waveguide 52. The waveguide 52 possesses a mechanical lip (not shown), which fits into the metal (stainless steel, brass, etc.) mesh gasket (not shown) on the bottom assembly 54. As with the magnetron assembly 10 of FIGS. 1 and 2, the vacuum tube 26 employed in the modular magnetron 50 of FIGS. 4 and 5 requires intimate contact with the cooling assembly 64 to maximize the transfer of heat from the vacuum tube 26 for maintaining proper operation without damage. That is, the cooling assembly 64 requires a thermally conducting connection to the vacuum tube body (anode) 32. Unlike the cooling assembly 18 of conventional magnetron assemblies 10 described in FIGS. 1 and 2 above, in a modular design, the press-fit approach may not work reliably once the first vacuum tube 26 is removed, since the cooling assembly 64 may become deformed by minor imperfections of the first vacuum tube body 32 and/or by the process of removing the vacuum tube 26 from the modular magnetron assembly 50. The cooling assembly 64 is configured to employ a flexible clamp-type design about the vacuum tube body 32 that also maintains thermal and electrical conductivity. The vacuum tube body 32 preferably receives a coating of thermal paste or oil before insertion in to the cooling assembly 64. An example of flexible clamp-type design of the cooling assembly 64 is described below in connection with FIG. 6.

A 'universal vacuum tube' may be employed for both 2 kW and 3 kW applications, with the only vacuum tube product differentiators being the frequency range of operation (low, nominal, or high).

Once the vacuum tube 26 is inserted into the cooling assembly 64 and fastened, the top assembly 58 is connected to the bottom assembly 54. According to an embodiment of the present invention, the two assemblies 54, 58 are fastened together by removable fasteners, such as screws 72 and nuts 74 with alignment slots or stops 76, 78 in the top yoke 68 and the bottom yoke 60, respectively. Alternatively, according to another embodiment of the present invention, alignment slots may be located in the cooling assembly 64 instead of the bottom yoke 60. According to certain embodiments of the present invention, the electrical connections 30 of the top portion 28 of the vacuum tube 26 may have a push-on type connector or may have a more robust screw-terminal connection that may be accessed through the connection box (top) 70. (The connection box 70 may also contain various filter elements to reduce electro-magnetic interference produced by the modular magnetron 50 or by the driving circuitry of the vacuum tube 26 (not shown)). The vacuum tube 26 may be keyed or aligned within the bottom assembly 54 so that the electrical connections 30 of the vacuum tube 26 may be reliably located and mate with the connection box 70 of the top assembly 58.

Figure 6:
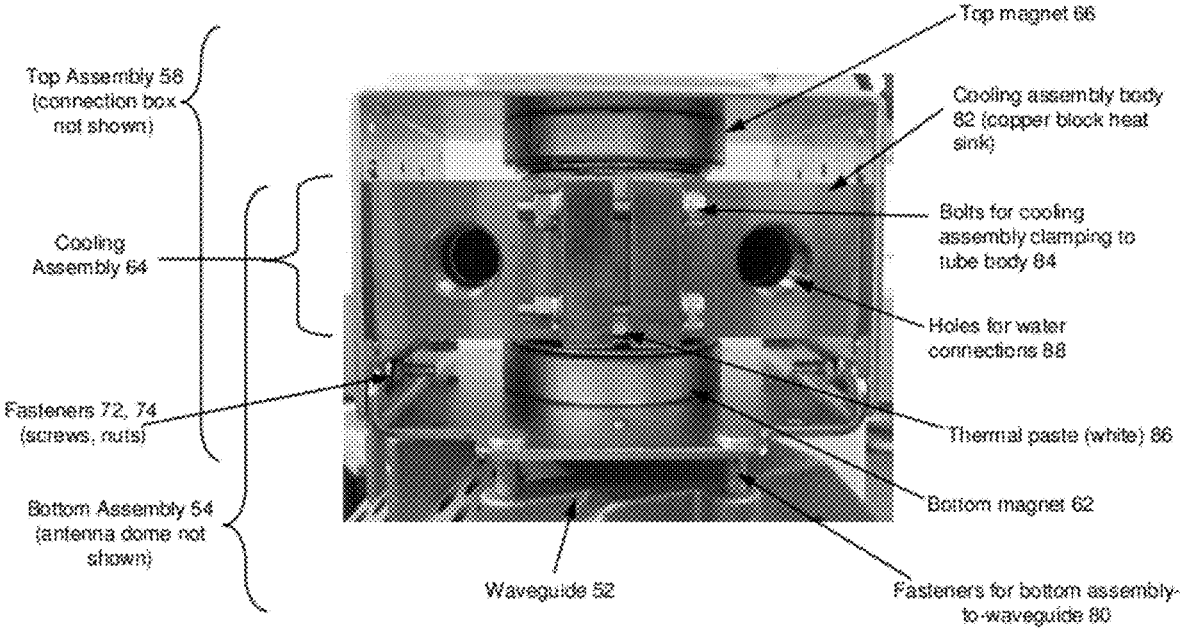
FIG. 6 is a photograph depicting a clamp-on liquid-cooled modular magnetron cooling assembly, according to an embodiment of the present invention.

FIG. 6 is a photograph depicting a (machine-bore) clamp-on liquid-cooled modular magnetron cooling assembly 64, according to an embodiment of the present invention. Also depicted in FIG. 6 is the top assembly 58 fastened with removable fasteners (screws and nuts) 72, 74 to the bottom assembly 54. The connection box 70 and the vacuum tube 26 of FIGS. 4 and 5 are not shown. Still further depicted in FIG. 6 are fastener bolts 80 in the bottom assembly 54 for fastening the bottom assembly 54 to the waveguide 52. Referring now to FIGS. 3 and 6, the liquid cooled cooling assembly 64 design is constructed using a copper block heat sink 82, with a cylindrical interior aperture (not shown) bored to closely match the outer diameter of the vacuum tube 26. The facing side of the copper block heat sink 82 is split and fastened with bolts 84 to produce a reliably tight clamp-on fit of the cooling assembly 64 to the vacuum tube body 32, and is configured to allow repeated vacuum tube removal upon loosening of the bolts 84. White thermal (electronic) grease (paste) 86 may be employed to increase the heat transfer from the vacuum tube body 32 to the cooling assembly 64. The copper block heat sink 82 has threaded holes 88 for water connections, although other fittings may be soldered or brazed to the copper block heat sink 82. According to another embodiment, a similar clamp-on design may be used with air-cooled fins.

Conventional (microwave powered) UV curing lamps use either 2 kW or 3 kW magnetrons. The only difference between the 2 kW and 3 kW (output powers) designs is the strength of the magnetic field (i.e., the strengths of the magnets in the assembly). Using permanent magnets and a non-modular magnetron design, a truly universal magnetron cannot be produced, since the magnetic field (i.e., the magnets) cannot be changed. To make a truly universal magnetron, a replacement set of permanent magnets is needed using the modular magnetron design of the present invention to convert from 2 kW operation to 3 kW operation. With standard (inexpensive) ferrite magnets, a 3 kW magnetron may be configured to have three magnets replacing the top magnet 66 in the top assembly 58 compared to one magnet used in a 2 kW design.

According to another embodiment of the present invention, the top magnet 66 and the bottom magnet 62 may be a permanent magnet made of non-ferrite material. More expensive rare-earth and/or Alnico permanent magnets allow a 3 kW magnetron to use a single top magnet because much larger magnetic fields are generated because of better magnetic properties of these materials.

According to still another embodiment of the present invention, the permanent magnetic materials of one or both of the top magnet 66 and the bottom magnet 62 may be replaced with electromagnets. In this embodiment, a universal magnetron assembly can be produced, with the power levels (2-5 kW) determined by the magnetic field strength (i.e., with an electromagnet coil) and the level of the magnetron input signal delivered to the filament leads 30.

The modular magnetron 50 has many advantages over prior art magnetron assemblies, such as the magnetron assembly 10 of FIGS. 1 and 2. Since a 'universal vacuum tube' is already used for both 2 kW and 3 kW applications, the only vacuum tube product (or stock) differentiator is the frequency range of operation (low, nominal, or high). Thus, the manufacturing, stocking, and tracking of many assembled magnetrons may be reduced to only a categorized frequency range. With a stackable assembly of magnets and cooling assembly (using a 'clamp on' cooling design as described above), magnetron replacement may be slightly more labor intensive but the flexible design greatly enhances manufacturability and reduces the number of required stock items. Since the lifetime of a UV curing lamp assembly is many years, and at constant operation, the magnetrons in the prior art are replaced (at least) yearly. In stark contrast, a modular magnetron provides significant savings in materials cost, manufacturability, and shipping (less than half the weight of the present magnetron is the vacuum tube), since "magnetron" replacement would entail only replacing the vacuum tube 26.

With electromagnets (or a combination of permanent and electro-magnets), the magnetic field of the magnetron becomes modifiable and thereby a truly 'universal magnetron' may be created that may be optimized for any output power level.

It is to be understood that the exemplary embodiments are merely illustrative of the invention and that many variations of the above-described embodiments may be devised by one skilled in the art without departing from the scope of the invention. It is therefore intended that all such variations be included within the scope of the following claims and their equivalents.

What is claimed is:

1. A modular magnetron, comprising:

a vacuum tube having a vacuum tube body;

a top assembly configured to substantially overlay the vacuum tube; and a bottom assembly configured to substantially extend about the vacuum tube, the vacuum tube positioned to partially protrude from the bottom assembly, the bottom assembly including a cooling assembly configured to employ a flexible clamp-type fitting about the vacuum tube body for substantially maintaining thermal and electrical conductivity, the cooling assembly comprising a heat sink, wherein a facing side of the heat sink is split and fastenable to produce a snug clamp-on fit of the cooling assembly to the vacuum tube body and to permit repeated vacuum tube removal, wherein the top assembly is configured to be releasably fastened to the bottom assembly about the vacuum tube with removable fasteners.

2. The modular magnetron of claim 1, wherein the cooling assembly is liquid cooled.

3. The modular magnetron of claim 1, wherein the heat sink is a copper block heat sink.

4. The modular magnetron of claim 1, wherein the heat sink has a cylindrical interior aperture bored to match the outer diameter of the vacuum tube body.

5. The modular magnetron of claim 1, wherein the heat sink is threaded with holes for water connections.

6. The modular magnetron of claim 1, wherein the cooling assembly includes a plurality of thin plates.

7. The modular magnetron of claim 1, wherein the top assembly further comprises one or more top magnets and the bottom assembly further comprises one or more bottom magnets, the one or more top magnets and the one or more bottom magnets each configured to substantially fit about the vacuum tube, the one or more bottom magnets configured to underlay the cooling assembly.

8. The modular magnetron of claim 7, wherein at least one of the one or more top magnets or the one or more bottom magnets is made of one of a rare-earth material or Alnico.

9. The modular magnetron of claim 7, wherein at least one of the one or more top magnets or the one or more bottom magnets is an electromagnet.

10. The modular magnetron of claim 7, wherein the top assembly further comprises a top yoke configured to overlay the at least one top magnet and the vacuum tube and a connection box overlying the top yoke, and the bottom assembly further comprises a bottom yoke configured to underlay the at least one bottom magnet and to receive therethrough the vacuum tube.

11. The modular magnetron of claim 1, wherein the top assembly and the bottom assembly are aligned with each other with opposing alignment slots extending outward from the top yoke and the bottom yoke, respectively, using removable fasteners.

12. The modular magnetron of claim 10, wherein the vacuum tube further comprises a top portion with electrical connections extending therefrom, the electrical connections each having one of a push-on type connector or a screw-terminal connection that is accessible through the connection box.

13. The modular magnetron of claim 12, wherein the vacuum tube is configured to be keyed within the bottom assembly so that the electrical connections of the vacuum tube mate with the connection box.

14. The modular magnetron of claim 10, wherein the connection box includes filter elements to reduce electro-magnetic interference.

15. The modular magnetron of claim 1, wherein the bottom assembly is configured to be fastened to a waveguide, the waveguide having an opening for receiving an antenna dome of the vacuum tube, the antenna dome configured to emit microwave radiation.

16. A method for manufacturing a modular magnetron, comprising:

providing a vacuum tube having a vacuum tube body, a top assembly configured to substantially overlay the vacuum tube, and a bottom assembly configured to substantially extend about the vacuum tube, the vacuum tube being positioned to partially protrude from the bottom assembly, the bottom assembly including a cooling assembly comprising a flexible clamp-type fitting and a heat sink, wherein a facing side of the heat sink is split and fastenable to produce a snug clamp-on fit of the cooling assembly to the vacuum tube body and to permit repeated vacuum tube removal;

fitting the flexible clamp-type fitting about the vacuum tube body;

receiving the vacuum tube in the bottom assembly and the top assembly; and fastening the top assembly to the bottom assembly about the vacuum tube with releasably removable fasteners.

17. The method of claim 16, further comprising the step of liquid cooling the cooling assembly.

18. The method of claim 16, wherein the top assembly further comprises one or more top magnets and the bottom assembly further comprises one or more bottom magnets, and further comprising fitting the one or more top magnets and the one or more bottom magnets substantially about the vacuum tube.

19. The method of claim 18, wherein one or more top magnets or the one or more bottom magnets is an electromagnet.

20. The method of claim 16, further comprising the top assembly and the bottom assembly with each other with opposing alignment slots extending outward from the top yoke and the bottom yoke, respectively, using removable fasteners.

* * * * *